United States Patent [19]

Colvin et al.

[11] Patent Number: 4,905,989

[45] Date of Patent: Mar. 6, 1990

[54] FALL INTERVENTION GARMENT

[75] Inventors: David P. Colvin; Virginia S. Colvin, both of Apex, N.C.

[73] Assignee: Triangle Research and Development Corporation, Raleigh, N.C.

[21] Appl. No.: 303,489

[22] Filed: Jan. 27, 1989

[51] Int. Cl.[4] ..... A63B 1/00; A63B 3/00

[52] U.S. Cl. ..... 272/70; 272/144; 2/102; 2/115; 128/874

[58] Field of Search ..... 272/70–70 A, 272/70 A, 119, 143, 144; 2/102, 21, 310, 311, 341, 342; 128/869, 874, 875, 876, 879; 182/3, 9; 297/465, 484, 485

[56] References Cited

U.S. PATENT DOCUMENTS

| | | | |
|---|---|---|---|
| 1,178,397 | 4/1916 | Harvey | 2/102 X |
| 1,573,446 | 2/1926 | Popham . | |
| 1,749,999 | 3/1930 | Crocker | 434/255 X |
| 2,675,856 | 4/1954 | Abdallah | 272/63 X |
| 3,524,679 | 8/1970 | De Lavenne . | |
| 4,050,737 | 9/1977 | Jordan . | |
| 4,089,064 | 5/1978 | Chandler, Jr. | 272/143 X |
| 4,143,914 | 3/1979 | Klich . | |
| 4,235,474 | 11/1980 | Rosenberg . | |
| 4,303,041 | 12/1981 | Thompson et al. | 272/70 A X |
| 4,341,421 | 7/1982 | Rowley . | |
| 4,571,000 | 2/1986 | Holder . | |
| 4,674,800 | 6/1987 | Ensign . | |
| 4,702,523 | 10/1987 | Schrader et al. . | |
| 4,759,569 | 7/1988 | Potter . | |

*Primary Examiner*—Richard J. Apley
*Assistant Examiner*—D. F. Crosby
*Attorney, Agent, or Firm*—Robert G. Rosenthal

[57] ABSTRACT

A fall intervention garment adapted to secure a person to a tethered supporting structure is disclosed. The garment is generally in the form of a vest and includes an upper section and a lower section. The lower section is formed so as to be responsive to a load being placed on the upper section for generating an inwardly directed holding force about the person's torso area. Attachment ring are connected to the upper section for detachably connecting the vest to a support structure.

14 Claims, 2 Drawing Sheets

FALL INTERVENTION GARMENT

FIELD OF THE INVENTION

This invention relates generally to restraining garments of the type which are worn by the elderly or those undergoing physical therapy to support them during ambulation.

BACKGROUND OF THE INVENTION

Confining and restraining devices are well known in the art and are usually employed to confine an elderly or infirmed patient to a wheel chair, bed and the like, to prevent injuries which may be caused as the result of a fall.

In addition, harnesses have been developed for use in suspending debilitated ambulatory patients. Such a system is disclosed in U.S. Pat. No. 3,780,663 to Pettit. The Pettit system includes a suspended overhead track network and a travelling "truck" supported by and adapted to roll along the track. A harness depends from the truck and is worn by the patient. The harness is connected to the truck by a tether and supports the patient in suspension during ambulation. The amount of support provided is adjusted according to the needs of each individual patient by means of an electric motor mounted to the truck.

Unfortunately, existing garments and harnesses have not been designed to ensure a comfortable fit. For example, with respect to the aforementioned patent, during ambulation of the patient, the garment may be essentially passive for a patient capable of walking without assistance and a degree of comfort may be afforded. However, during raising and lowering of the patient, or if a portion of the patient's weight is supported by the system during ambulation, the garment becomes active and due to an unsatisfactory concentration of the forces at one or more points on the garment, will result in discomfort to the patient due to cinching at certain points, particularly, the under arms, back, and groin area.

Another drawback to garments of this type is that they often interfere with the bodily functions of the wearer as they must be removed prior to use of restrooms, thus limiting their usefulness.

Furthermore, many of these garments are cumbersome to remove and require the unbuckling of straps, untying of knots, etc.

It is accordingly an object of the present invention to provide a fall intervention garment which overcomes the above-noted problems with the prior art, and which is comfortable.

It is another object of the present invention to provide a fall intervention garment which distributes the forces induced by a tether during support or a fall so as to minimize cinching or stress concentrations around fragile ribs.

It is a further object of the present invention to provide a fall intervention garment which does not interfere with bodily functions and which is easily removable.

It is still another object of the present invention to provide a fall intervention garment which approximates a vest and thereby obtains increased patient acceptance.

SUMMARY OF THE INVENTION

In accordance with the present invention there is provided a fall intervention garment adapted to secure a person to a tethered supporting structure. The garment takes the shape of a vest and has an upper section and a lower section. The lower section includes means responsive to a load being placed on the upper section for generating a circumferential or inwardly directed holding force about the person's torso area. The vest includes attachment means connected to the upper section for detachably connecting the vest to a supporting structure. Thus, when a force is applied to the attachment means, it will be transmitted through the upper section into the lower section and will be substantially evenly distributed thereabout, thereby comfortably and evenly constricting the lower section about the torso of the wearer.

BRIEF DESCRIPTION OF THE DRAWINGS

Some of the features and advantages of the invention having been briefly stated, others will appear from the detailed description which follows, when taken in connection with the accompanying drawings, in which—

DETAILED DESCRIPTION OF THE PREFERRED EMBODIMENT

While the present invention will be described more fully hereinafter with reference to the accompanying drawings, in which a particular embodiment is shown, it is to be understood at the outset that persons skilled in the art may modify the invention herein described while still achieving the favorable results of this invention. Accordingly, the description which follows is to be understood as a broad teaching disclosure directed to persons of skill in the appropriate arts and not as limiting upon the present invention.

Figure 1:
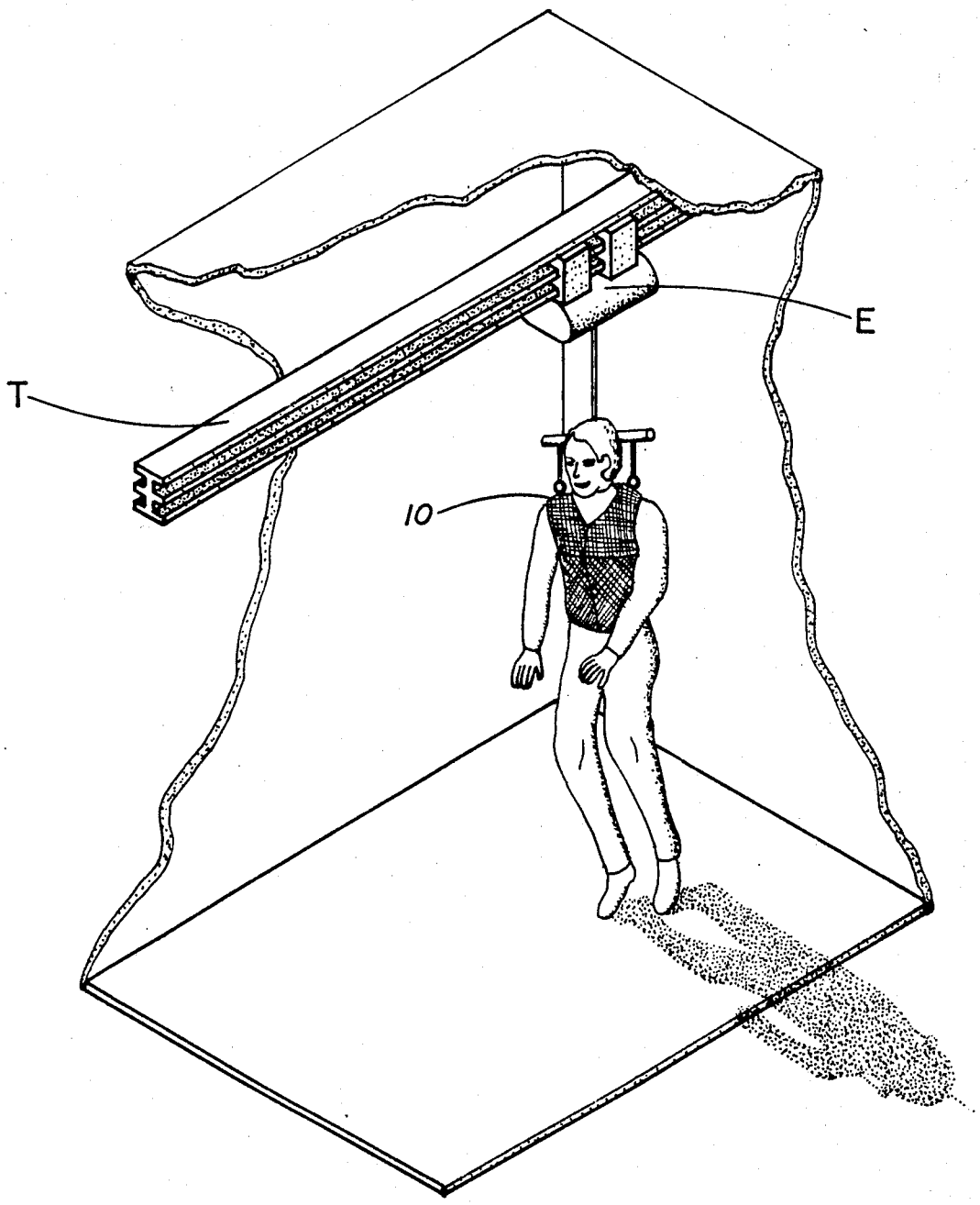
FIG. 1 is a perspective view of a track-type or tethered exercise system having a person secured thereto and wearing the vest garment which embodies the features of the present invention.
Figure 2:
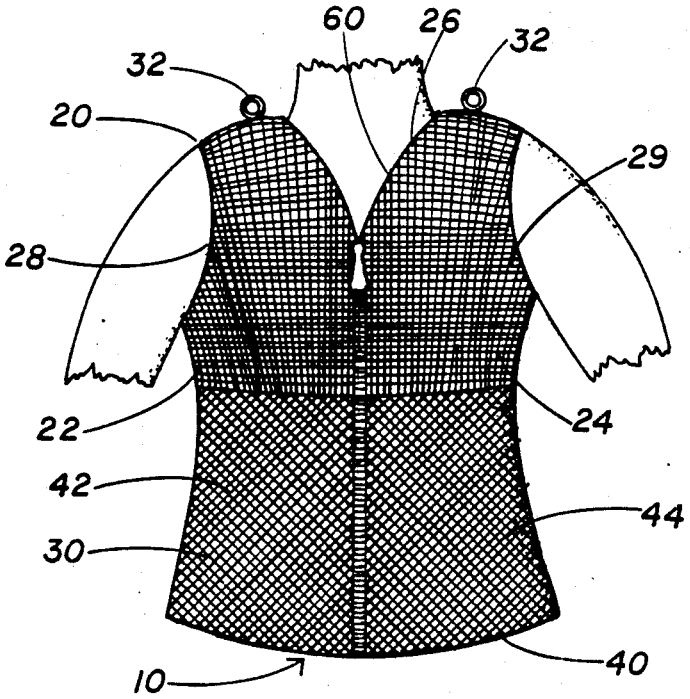
FIG. 2 is a front view of a person's torso wearing the vest of the present invention.
Figure 4:
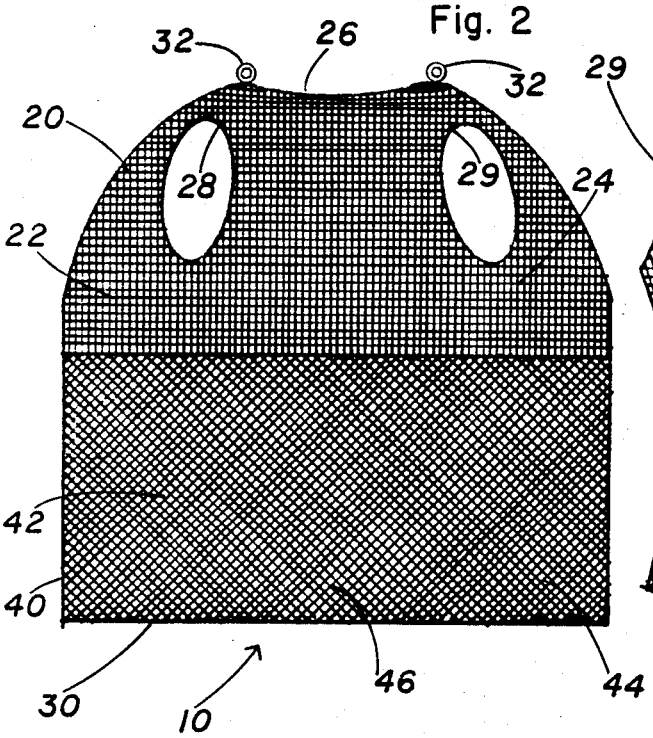
FIG. 4 is a front view of the vest of the present invention viewed in a flattened condition from the inside.
Figure 3:
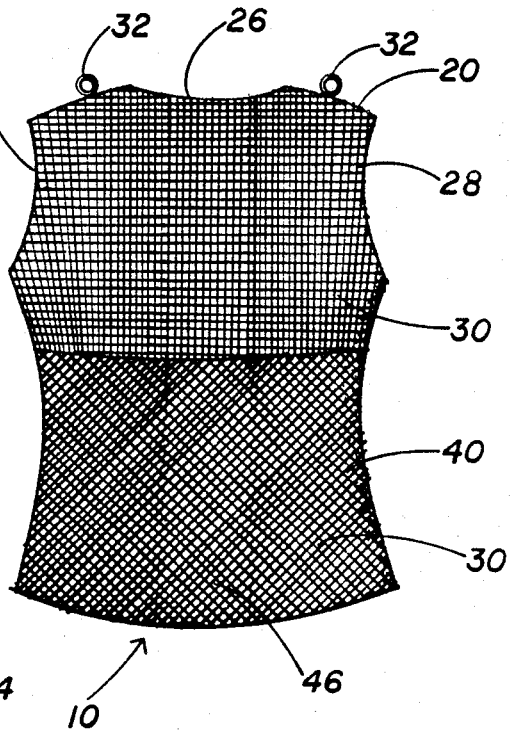
FIG. 3 is a rear view of the vest of the present invention.

Referring more particularly to the drawings, a vest which embodies the features of the present invention is generally indicated at 10. The vest 10 is adapted to cover the upper torso and shoulders of the wearer and to be connected to a track based exercise system E as shown in FIG. 1. The exercise system is designed so that a person may ambulate under his own power along the track T and in the event of a fall or loss of balance, the person will be slowly and gently lowered to the floor without injury.

The vest 10 comprises an upper section 20 and a lower section 40 and is preferably fabricated from a woven fabric as will be explained in greater detail hereinbelow.

The upper section 20 includes a front right section 22, a front left section 24, and a rear section 30. The upper section also includes a head opening 26 and arm openings 28, 29. The respective upper front sections 22, 24 are connected to the upper rear section at the shoulder and also beneath the respective arm openings. An attachment means 32 in the form of a pair of D-rings is also provided above the shoulders. A D-ring is connected to the upper section of the vest 10 in a location between the head opening 26 and each of the arm openings 28, 29. The attachment means 32 may also take the form of a rigid support means such as an elongate rod or strip that is connected to the upper rear section of the vest proximate to and parallel with the shoulders of the wearer that is adapted to be connected to the tether at a single, centrally located point behind the head opening (not shown).

The lower section 40 includes a front lower left section 42 and a front lower right section 44 and a rear lower section 46 which are integral and thus seam free along the sides.

A closure means 60 or separating zipper is provided and extends along the front of the vest from the head opening 26 longitudinally along the entire length of te upper and lower sections 20, 40.

The vest 10 is constructed so as to implement the basic principle of the "chinese finger puzzle" wherein a longitudinal tension force applied to the puzzle is translated into an evenly distributed circumferential stress. To implement the foregoing principle, the vest is constructed so that an upward force applied at the D-rings is transmitted through upper section 20 and into the lower section 40 where it is substantially evenly distributed.

More specifically, the upper section 20 is cut along the straight grain of a woven fabric so that the fabric has minimal stretch in the direction of an upward force applied at the D-rings. In fact, it is sometimes desirable to sew an additional liner on the inside of the upper section to further minimize stretch. Similarly, the lower section is cut with the fabric bias or at an angle of 45 degrees to the straight grain so that the fabric stretches in the direction of an applied force. The desired amount of elongation is in the order of 20–30%.

In operation, the wearer is connected to the exercise system by means of a tether or cable attached to the D-rings 32. When the wearer is self-supporting and properly ambulating, the fit of the vest is comfortable, but snug. In order to ensure a snug fit, and also so that one size vest can be used to fit a predetermined range of differently sized persons, it may be advantageouse to include an area of circumferential adjustment means in the back of the garment (not shown). This adjustment means can take the form of a series of vertically spaced apart straps, buckles, etc. located along the back of the garment for increasing or decreasing the circumference of the garment. When the wearer loses his balance or is otherwise unable to support his own weight, the exercise system E exerts an upward supporting force on the vest 10 which is applied at the attachment means. This force is transmitted through the upper section 20 into the lower section 30. This causes the bias cut lower section to be stretched or elongated, creating an even constricting or inwardly directed circumferential force about the torso of the wearer.

It will be noted that the vest illustrated may be modified while still retaining the functionality thereof. For example, the proportions of the upper and lower sections may be modified depending on torso length or sex of the patient and the like. In fact, vests have been constructed where the lower section extends all the way up to the under arm area with no loss of efficacy or comfort.

The foregoing embodiments and examples are to be considered illustrative, rather than restrictive of the invention, and those modifications which come within the meaning and range of equivalence of the claims are to be included therein.

That which is claimed is:

1. A fall intervention garment adapted to secure a person wearing the garment to a tethered supporting structure and comprising:

a vest having an upper section and a lower section, said lower section including means responsive to a load being placed on the upper section for generating an inwardly directed holding force about the person's torso area;

attachment means connected to the upper section for detachably connecting the vest to a supporting structure, whereby a force applied to the attachment means will be transmitted through the upper section into the lower section and will be substantially evenly distributed thereabout thereby comfortably and evenly constricting the lower section about the torso of the wearer.

2. The garment according to claim 1 wherein the lower section comprises a fabric material.

3. The garment according to claim 1 wherein the upper and lower sections comprise a fabric material.

4. The garment according to claim 1 wherein said attachment means comprises a pair of spaced apart rings.

5. A fall intervention garment adapted to secure a person wearing the garment to a tethered supporting overhead structure and comprising:

a vest having an upper section and a lower section, said upper section including a centrally located head opening and a pair of arm openings adapted to receive the respective head and arms of the wearer, said lower section including means responsive to a load being placed on the upper section for generating an inwardly directed circumferential holding force about the person's torso area;

attachment means connected to the upper section for detachably connecting the vest to the overhead supporting structure, whereby a force applied to the attachment means will be transmitted through the upper section into the lower section and will be substantially evenly distributed thereabout thereby comfortably and evenly constricting the lower section about the torso of the wearer.

6. The garment according to claim 5 wherein the upper section comprises a front portion and a rear portion adapted to overlie the respective chest and back of the wearer, and wherein said attachment means comprises a pair of spaced apart rings connected to said rear portion.

7. The garment according to claim 5 wherein the upper and lower sections are made of a fabric.

8. The garment according to claim 7 wherein the upper section is cut so as to substantially transmit a force applied to the attachment means through the upper section into the lower section and wherein the force will cause the lower section to comfortably and evenly constrict about the torso of the wearer.

9. The garment according to claim 6 wherein the front portion further includes an upper left front portion and an upper right front portion and wherein the lower section includes a left lower section and a right lower section, and closure means for detachably connecting the respective left and right upper front portions and the left and right lower front portions, said closure means extending longitudinally therebetween.

10. The garment according to claim 9 wherein said closure means comprises a zipper.

11. A vest-like fall intervention garment adapted to secure a person wearing the garment to a tethered supporting exercise structure and the like and comprising:

a fabric vest having a front portion and a rear portion, said front portion including upper left and upper right sections and a lower left and lower right section and said rear portion having an upper section and a lower section, said lower sections being integral and thus seam free along the sides;

said upper sections being connected at the shoulder and including a medially located head opening, and being cut against the fabric bias and said lower sections being cut with the fabric bias;

armholes between said upper rear section and each of said front sections;

closure means connected to said front portion for detachably fastening the respective upper left and right upper sections and said lower left and lower right sections;

attachment means connected to the rear portion proximate each side of said head opening for detachably connecting the vest to a supporting structure, whereby a force applied to the attachment means will be transmitted through the upper sections into the lower sections and will be substantially evenly distributed thereabout thereby comfortably and evenly constricting about the torso of the wearer.

12. The garment according to claim 1 further including a circumference adjustment means for snugly fitting the garment against the body of the wearer.

13. The garment according to claim 1 wherein the attachment means comprises a rigid support means connected to the upper rear section of the vest and the central portion thereof adapted to be connected to the tether at a single, centrally located point.

14. The garment according to claim 13 wherein the rigid support means comprises an elongate rod.

* * * * *